US005648041A

United States Patent [19]

Rodgers et al.

[11] Patent Number: 5,648,041

[45] Date of Patent: Jul. 15, 1997

[54] PROCESS AND APPARATUS FOR COLLECTING FIBERS BLOW SPUN FROM SOLVATED MESOPHASE PITCH

[75] Inventors: John A. Rodgers, Ooltewah, Tenn.; Joseph A. Perrotto, Landenberg, Pa.; Robert C. Boger, Wilmington, Del.

[73] Assignee: Conoco Inc., Ponca City, Okla.

[21] Appl. No.: 436,030

[22] Filed: May 5, 1995

[51] Int. Cl.[6] ..... D01D 5/12; D01F 9/12

[52] U.S. Cl. ..... 264/555; 264/103; 264/211.11; 264/211.14; 425/66; 425/72.2; 425/378.2; 425/382.2; 425/404; 425/464

[58] Field of Search ..... 264/103, 211.11, 264/211.14, 555; 425/66, 72.2, 326.1, 378.2, 382.2, 404, 464

[56] References Cited

U.S. PATENT DOCUMENTS

| | | | |
|---|---|---|---|
| 3,755,527 | 8/1973 | Keller et al. | 264/555 X |
| 4,402,900 | 9/1983 | Berry, Jr. | 264/205 |
| 4,526,733 | 7/1985 | Lau | 425/72.2 X |
| 4,627,811 | 12/1986 | Greiser et al. | 425/72.2 |
| 4,687,610 | 8/1987 | Vassilatos | 264/211.14 |
| 4,818,463 | 4/1989 | Buehning | 264/555 X |
| 4,820,142 | 4/1989 | Balk | 425/66 |
| 4,838,774 | 6/1989 | Balk | 425/66 |
| 5,141,699 | 8/1992 | Meyer et al. | 264/518 |
| 5,141,700 | 8/1992 | Sze | 264/555 |
| 5,145,689 | 9/1992 | Allen et al. | 425/72.2 |
| 5,236,641 | 8/1993 | Allen et al. | 264/555 X |
| 5,259,947 | 11/1993 | Kalback et al. | 208/44 |
| 5,269,670 | 12/1993 | Allen et al. | 425/72.2 |
| 5,503,784 | 4/1996 | Balk | 264/211.14 X |

FOREIGN PATENT DOCUMENTS

| | | | |
|---|---|---|---|
| 63-85116 | 4/1988 | Japan | 264/555 |

OTHER PUBLICATIONS

Patent application Ser. No. 08/135,204 entitled Improved Process for Making Solvated Mesophase Pitch, filed Oct. 12, 1993.

Superfine Thermoplastic Fibers, Industrial and Engineering Chemistry, vol. 48, No. 8, Aug. 1956, pp. 1342–1346.

*Primary Examiner*—Leo B. Tentoni
*Attorney, Agent, or Firm*—William D. Hall

[57] ABSTRACT

The present invention provides a process and apparatus for collecting relatively straight blow spun fibers in a two dimensional configuration. The process utilizes a venturi to preclude the kinking and bending of the fibers until the fibers have substantially thermoset. A diffusion chamber allows the fibers to be collected without entangling.

21 Claims, 2 Drawing Sheets

PROCESS AND APPARATUS FOR COLLECTING FIBERS BLOW SPUN FROM SOLVATED MESOPHASE PITCH

I. BACKGROUND AND SUMMARY OF THE INVENTION

A. Summary of the Invention

The present invention provides a process and apparatus for collecting and laying down blow spun fibers which are relatively free of kinks and bends. Additionally, the present invention provides a method and apparatus for collecting the fibers in a substantially unentangled or two dimensional configuration.

B. Background of the Invention

The methods and devices for blow spinning fibers are well known. In general, a spinnable substance is heated to a temperature which will allow it to flow. This substance then passes, usually under pressure, into a spinning die which has one or more capillaries. The substance passes through a capillary and exits as a fiber. Upon exiting the capillary, the fiber is contacted with an attenuating media, usually a gas. The attenuating media draws or stretches the fiber increasing its length while decreasing its diameter.

Several types of dies are utilized for blow spinning fibers. Two common dies are the annular and slot dies. Annular and slot dies primarily differ in the manner in which the attenuating gas is directed upon the exiting fiber. The present invention has equal application for all types of blow spinning dies.

In prior spinning methods, the spun fibers would fall to a collection surface following attenuation. Depending upon the composition of the fibers, this method resulted in fibers which were bent or kinked and which accumulated in a random three dimensional pile. One of the primary factors producing this result is believed to be the generation of turbulence about the fiber by the attenuating gas.

Accordingly, the present invention is directed to an apparatus and process for laying down and collecting substantially straight, blow spun fibers. Additionally, the process and apparatus of the present invention provides for the relatively two dimensional collection of the fibers in a substantially unentangled manner.

II. BRIEF DISCLOSURE OF THE INVENTION

The present invention provides a process and an apparatus for laying down and collecting blow spun fibers. According to the process of the present invention, a spinnable substance is heated to a temperature sufficient to allow it to flow. Upon reaching the requisite temperature, the spinnable substance passes under pressure into a blow spinning die head. Then while under pressure, the spinnable substance passes through a capillary exiting as a fiber. The resulting fibers are attenuated by an attenuating media. Typically, the attenuating media is a flowing gas stream.

While the above steps are well known in the art, the present invention provides a process and apparatus to preclude the bending, kinking and entanglement of blow spun fibers. According to the process of the present invention, following initial attenuation, the fiber enters and passes through a thermosetting zone. While within the thermosetting zone, the fiber must be maintained in a relatively straight configuration in order to preclude the formation of bends and kinks.

The present invention maintains the fiber in a relatively straight configuration during the thermosetting process by maintaining tension on the fiber in order to reduce or neutralize the effects of the turbulence. According to the preferred embodiment, the tension on the fiber is generated by contacting it with a second flowing gas stream as the fiber passes through the thermosetting zone. The second flowing gas stream contacts the fiber either before, after, or as the fiber enters a venturi. Because the second flowing gas stream has a velocity greater than the fiber, it maintains the fiber in a relatively straight configuration until the fiber substantially thermosets. Depending upon the delivery point of the second flowing gas stream, the gas stream velocity and the characteristics of the spinnable substance, the second flowing gas stream may further attenuate the fiber. At this point in the process, the resulting fiber has substantially thermoset in a configuration which is relatively free of bends and kinks.

The second flowing gas stream may be any gas, a liquid or even steam. Further, the second flowing gas stream may comprise single or multiple flowing streams of gas. However, for the purposes of this disclosure the substance and streams which tension the fiber will be referred to as a second flowing gas stream or second flowing stream of gas.

For the purposes of this disclosure, the thermosetting zone is defined as that region in which the fiber undergoes the thermosetting process. The thermosetting zone encompasses that region in space immediately adjacent to the exit of the capillary and extends some distance from the capillary exit. The actual size of the thermosetting zone will depend upon the spinning conditions, the temperature of the second flowing gas stream and the nature of the feedstock. The thermosetting zone may extend into the venturi; however, typically it will not extend beyond the venturi.

After exiting the venturi, the fibers pass into a diffusion chamber or region. The diffusion chamber provides a means for dissipating the gas stream which surrounds the fibers. In this manner, the present invention reduces the entanglement of the fibers as they are collected on a laydown surface located beneath the diffusion chamber.

The present invention additionally provides an apparatus for producing relatively straight blow spun fibers. This apparatus also provides for substantially entanglement free collection of the fibers. The apparatus includes a venturi, a diffusion chamber or region and a fiber laydown or collection surface.

As is known in the art, a blow spinning die head has at least one capillary suitable for generating a fiber. In general, the number of capillaries in a die is limited only by economic considerations. Additionally, a blow spinning die head will include a means for directing a flowing gas stream onto the fibers as they exit the capillaries.

According to the present invention, positioned downstream from the die head is the venturi. The venturi has a passage therethrough which receives the fiber as it exits the capillary. The venturi may contain a means for directing a second flowing gas stream onto the fiber. Alternatively, an external apparatus will provide a second flowing gas stream which enters the venturi along with the fiber. The second flowing stream of gas maintains the fiber in a relatively straight configuration while the fiber thermosets. Additionally, the second flowing stream of gas may further attenuate the fiber. The source of the second flowing stream of gas may be a blower, a vacuum pump or other suitable gas moving apparatus.

A diffusion chamber or region is positioned downstream of and/or adjacent to the venturi. The diffusion chamber is designed to dissipate the gas stream without entangling the fibers. In this manner, the diffusion chamber allows the fibers to fall without entangling onto the collection surface. The fibers generated and collected by this apparatus are relatively straight and untangled. The diffusion chamber or region may be an integral part of the venturi or may be a separate apparatus positioned adjacent to the venturi.

The apparatus of the present invention may optionally include an exhaust conduit. The exhaust conduit is positioned adjacent to the diffusion chamber and contains a laydown surface. The laydown surface may take several forms including a conveyor belt to allow for the continuous production of fibers. Preferably, the laydown surface is sufficiently porous to allow the gas to pass therethrough while retaining the fibers.

Further, the apparatus of the present invention may include a vacuum pump connected to the exhaust conduit. The vacuum pump pulls a vacuum on the exhaust conduit and aids in the collection of the fibers in a two dimensional format. In one embodiment of the present invention, the vacuum pump will pull sufficient air or gas through the venturi in order to maintain the fibers in a relatively straight configuration. Finally, the gas pressure generated by the vacuum pump may be directed to the spinning head to provide all or part of the initial flowing stream of gas for the blow spinning process.

III. BRIEF DESCRIPTION OF THE DRAWINGS

IV. DETAILED DESCRIPTION OF THE INVENTION

A. The Apparatus

Figure 1:
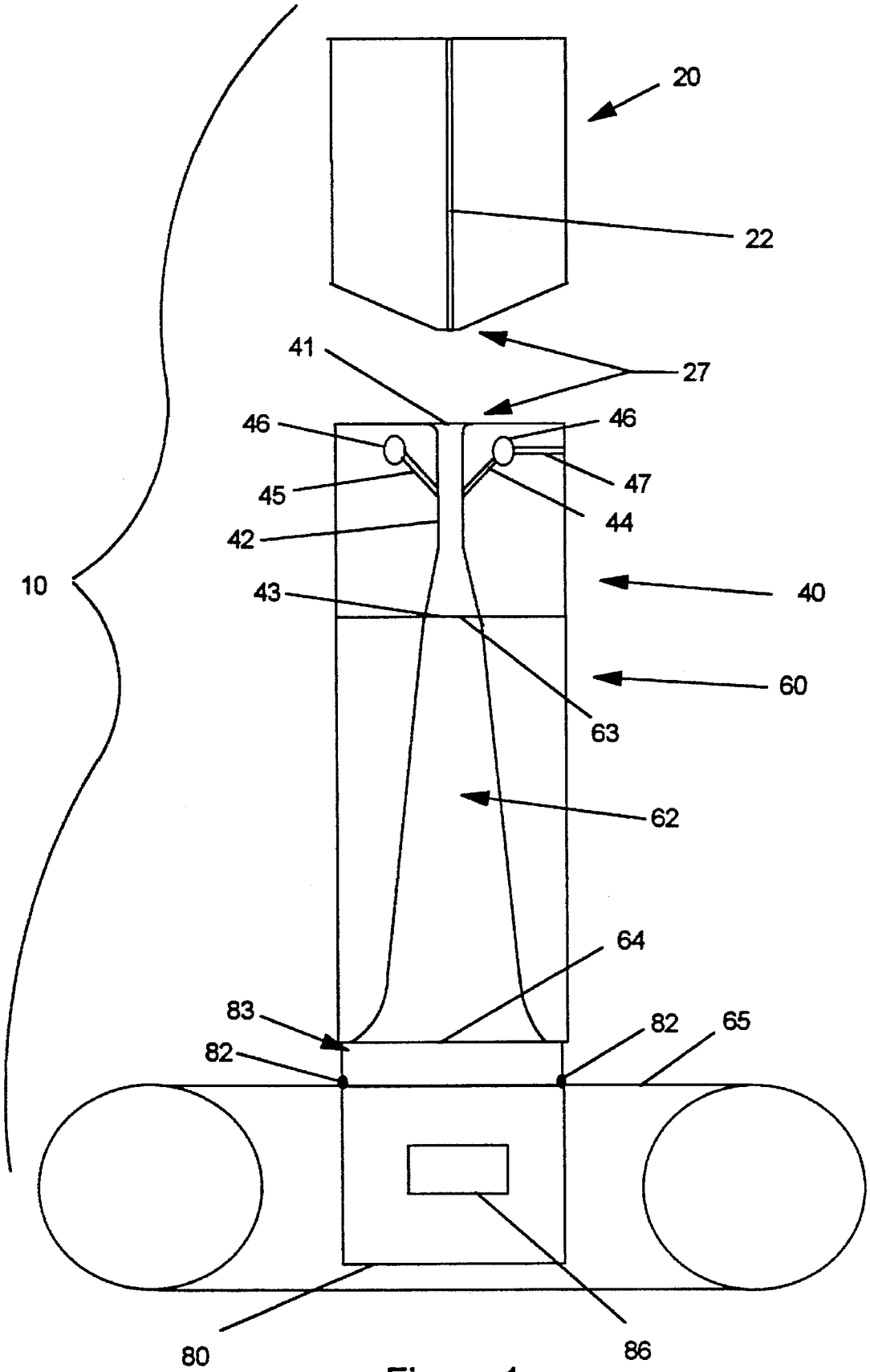
FIG. 1 is a side cut a way view of the apparatus of the present invention including the die head, the venturi, the diffusion chamber, an exhaust conduit and a laydown surface.

Referring now to the drawings, the present invention provides an Apparatus 10 for spinning and collecting relatively straight fibers in a relatively unentangled two dimensional format. Apparatus 10 includes a blow spinning die head 20, a venturi 40, a diffusion chamber 60 and a laydown surface 65. Optionally, the apparatus of the present invention includes an exhaust chamber 80 and a means for moving gas (not shown). The means for moving gas may be a vacuum pump, a blower or other suitable apparatus.

As is well know in the art, the spinning of fibers requires heating a spinnable material to a temperature sufficient to allow the substance to pass through a capillary. The means for heating the spinnable substance may be located externally of the blow spinning die or internally. Inasmuch as the methods and devices for blow spinning are well known, further details on this aspect are not necessary. Rather, greater detail is provided in U.S. Pat. Nos. 3,755,527; 4,526,733; 4,818,463 and the article "Superfine Thermoplastic Fibers" by Van A. Wente, Industrial Engineering Chemistry, Vol. 48, page 1342 (1956) which are incorporated herein by reference.

Positioned downstream of die head 20 is a venturi 40. Typically, venturi 40 will have a length of about fourteen inches or less. Depending on the nature of the fiber feedstock, venturi 40 and die head 20 may be a single unit or may comprise two units in direct contact. However, preferably a distance, defined as opening 27, will exist between die head 20 and venturi 40. Factors in determining the distance of opening 27 are the thermosetting characteristics of the spun fiber and the cooling effect of the second flowing gas stream. Typically, opening 27 will be a distance of from about 0.25 inches to about 100 inches. For example, in the case of fibers spun from solvated mesophase pitch, the distance will generally be between about two to four inches. However, the distance may be even greater than 100 inches for other fiber feedstocks. The preparation of solvated mesophase pitch is described in U.S. Pat. Nos. 5,259,947 and 5,437,780 which are incorporated herein by reference.

For carbon fibers spun from solvated mesophase pitch, the region between the die head and the venturi will typically correspond to the thermosetting zone of the fiber. However, for certain fibers, the thermosetting zone may extend into the venturi. As previously noted, the thermosetting zone is that region in space in which the fiber becomes thermoset.

Venturi 40 has a passage 42 extending through its length. Passage 42 has a first open end 41 and a second open end 43. Passage 42 is positioned downstream of capillary 22 in order to receive the spun fibers. Venturi 40 may contain two or more gas jets 44 and 45 for directing a gas stream onto the spun fibers as they passes through passage 42. Gas jets 44 and 45 may be flush with the walls of passage 42 or may extend into passage 42. Gas jets 44 and 45 are in fluid communication with a manifold 46 located within the venturi 40. Manifold 46 receives a supply of pressurized gas by means of passage 47 from an external source, not depicted.

Figure 2:
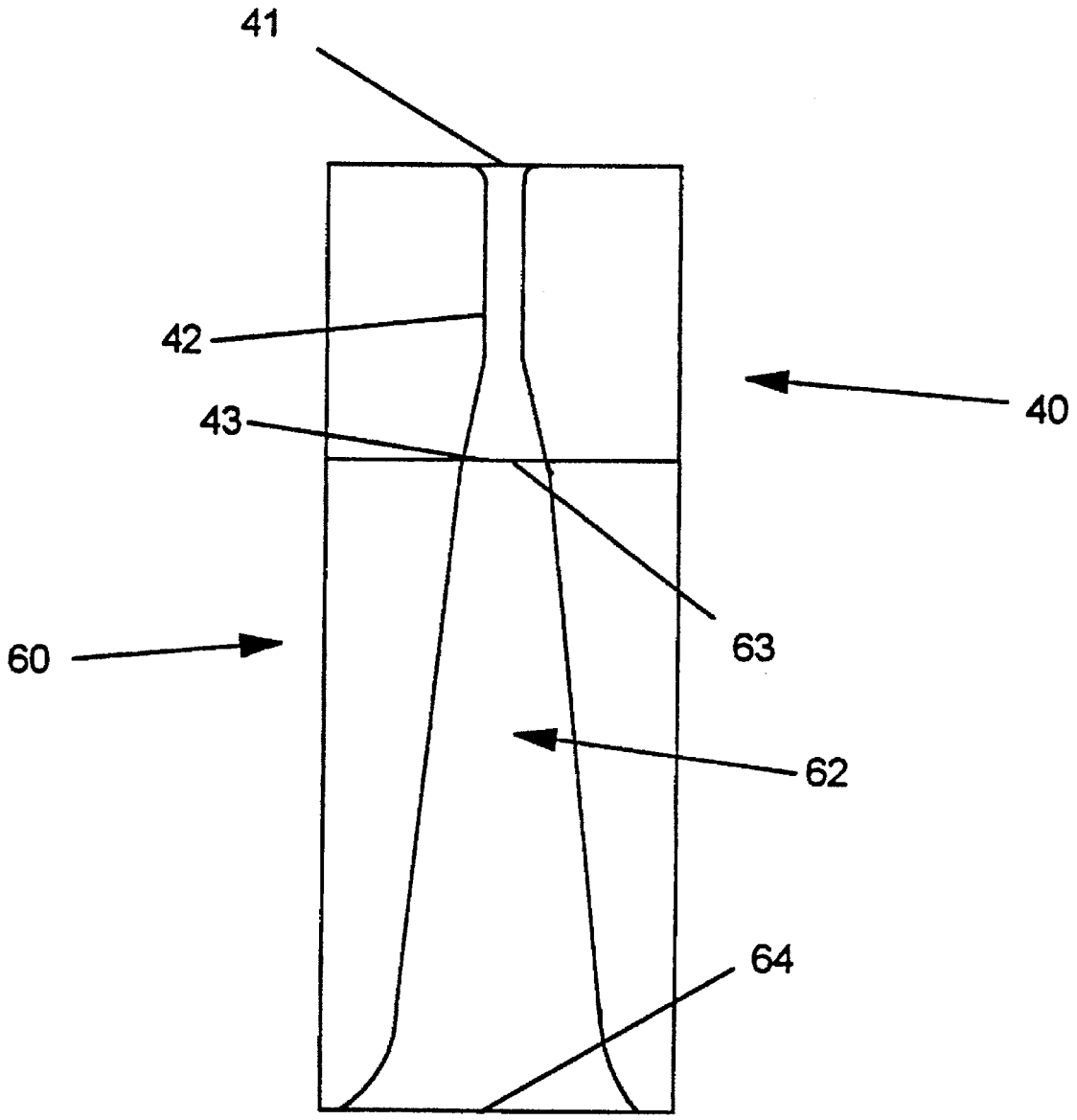
FIG. 2 is a side cut a way view of a preferred embodiment of the venturi and diffusion chamber.

In a preferred embodiment and particularly when spinning fibers from solvated mesophase pitch, apparatus 10 is located within a sealed chamber (not shown) which contains a non-reactive atmosphere. When spinning fibers from solvated mesophase pitch, the preferred atmosphere is an inert gas such as nitrogen. Further, in the preferred embodiment, pressurized nitrogen gas is passed into venturi 40 through open end 41. The gas passes with the spun fibers into venturi 40 and provides a second flowing gas stream to physically stabilize the fibers until they are substantially thermoset. In this manner, the second flowing gas stream passing with the fiber through venturi 40 tensions the fiber and reduces or neutralizes the effect of turbulence on the fiber which would otherwise lead to bent and kinked fibers. Further, this preferred embodiment eliminates the need for gas jets 44 and 45, manifold 46 and passage 47 within venturi 40 as shown in FIG. 2.

Positioned adjacent to and downstream of venturi 40 is a diffusion chamber or region 60. Diffusion chamber 60 receives the thermoset fiber as it exits from passage 42 and provides a means for dissipating the gas stream. As shown in the drawing, diffusion chamber 60 has an internal passage 62 which gradually increases in area as it progresses from a first open end 63 adjacent to passage 42 to a second open end 64. This gradual increase in area about the fiber as it passes through diffusion chamber 60, provides a means for dissipating the velocity and kinetic energy of the gas stream. This gradual dissipation of the energy of the second flowing gas stream minimizes and preferably precludes the development of turbulence about the fiber.

Naturally, other embodiments can easily be envisioned which will accomplish the same effect including a diffusion chamber having a constant internal area but which gradually opens up to the atmosphere. Examples of these alternative embodiment might include a screened or perforated chamber. Further, the present invention includes the construction of the venturi and the diffusion chamber as a single integral unit. Additionally, certain processing conditions may necessitate the heating of the walls of diffusion chamber 60 in order to preclude the condensation of monomer and/or spinning or solvating solvent thereon.

Positioned beneath diffusion chamber 60 is a laydown surface 65. Laydown surface 65 preferably will allow the gas stream to pass freely through its surface. Laydown surface 65 may be in the form of a foraminous screen, plate or a belt. A laydown surface 65 in the form of a conveyor belt may be desirable for its ability to transport fibers away from apparatus 10 allowing for continuous production of fibers.

Apparatus 10 may optionally include an exhaust conduit 80. When exhaust conduit 80 is utilized, laydown surface 65 may be located within or pass through conduit 80 as shown in the drawing. Exhaust conduit 80 has an opening 83 that surrounds end 64 of diffusion chamber 60. Positioned beneath end 64 is the laydown surface 65. Opening 83 allows the fibers to pass from diffusion chamber 60 onto laydown surface 65. Exhaust conduit 80 also has an opening 86 to allow for the venting of gases to the atmosphere. Optionally, these gases may be recycled to either gas source, repressurized and used in either the spinning head 20 or venturi 40. Further, when laydown surface 65 is a conveyor belt, exhaust conduit 80 may be provided with rolling seals 82 or other means to allow for passage of the belt and fibers out of exhaust conduit 80 without disrupting the flow of gas through conduit 80.

Apparatus 10 may optionally include an gas moving means (not shown). The gas moving means will have a negative pressure opening and a positive pressure opening. Typically, the gas moving means is a vacuum pump or a blower and it is used in conjunction with exhaust conduit 80 with the negative pressure opening being connected to exhaust conduit opening 86. In this configuration a vacuum pump will pull additional gas down through the fibers as they are collected on laydown surface 65. The passage of gas through the fibers enhances the collection of the fibers in a two dimensional format. The positive pressure opening of the gas moving means may be connected to the gas source of the blow spinning die allowing for the recycling of the gas used in the spinning process.

B. The Process

With continued reference to the drawings, the present invention provides a process for laying down and collecting relatively straight unentangled blow spun fibers. The present invention is particularly useful for producing carbon fibers from solvated pitch, including solvated mesophase pitch. The following discussion will center on the collection of fibers spun from a solvated mesophase pitch; however, one skilled in the art will recognize that the present invention will have application in all areas of blow spinning.

The process of the present invention is initiated by heating a spinnable substance such as solvated mesophase pitch to a temperature sufficient to allow it to pass through a capillary in a blow spinning die. The methods of heating and passing a spinnable substance through a capillary are well known in the art and will not be repeated herein. Also, as is well known in the art, when a blow spun fiber exits a capillary in a blow spinning die it is contacted with a flowing stream of gas. In a typical slot die, the gas is directed onto the fiber by at least two gas passages. In annular dies, the gas passes through a single passage which surrounds the capillary. In either case the flowing gas attenuates the fiber after it exits the capillary. As the fiber is attenuated it becomes thinner and longer.

Prior to the present invention, the blow spinning of carbonaceous pitch typically yielded bent and kinked carbon fibers. This kinking and bending of the fibers is attributed to the turbulence generated by the flowing gas stream. Because the fibers are kinked and bent prior to and during thermosetting, the resulting finished fibers are also kinked and bent. These fibers are extremely difficult to collect and usually accumulate in a low apparent density entangled three dimensional mass.

The process of the present invention advantageously provides for the collection of relatively straight fibers in a substantially non-entangled two dimensional format. According to this process, once the fibers exit the blow spinning die, they pass through a thermosetting zone, as previously defined, and into a venturi. Passing with the fibers into the venturi is a second flowing stream of gas. The second flowing stream of gas has a velocity greater than that of the fibers and places the fibers under tension during the thermosetting process. Thus, the second flowing gas stream maintains the fibers in a relatively straight configuration as they thermoset.

Depending on the composition of the fibers, the thermosetting process typically occurs prior to the fibers entering the venturi. However, regardless of the zone in which the fibers thermoset, they will remain relatively free of bends and kinks due to the tension placed on the fibers by the second flowing stream of gas. Thus, the second flowing stream of gas maintains tension on the fibers during the thermosetting process. In the preferred embodiment the gas does not chemically alter the fibers; however, some solvent may be removed from the fiber by passage of the gas. Thus, the fibers become substantially thermoset while remaining substantially free of kinks and bends.

Alternatively, as noted above, the venturi may internally provide a second flowing stream of gas directed at the fibers. The second flowing stream of gas operates in the manner described above to place tension on the fibers and maintain them in a relatively straight configuration until the fiber substantially thermosets. Additionally, depending on the nature of the spinnable substance, the second flowing gas stream within the venturi may further attenuate or draw the fiber.

In order to provide a cost effective fiber, the process must also preclude the entangling of the fiber as it accumulates on a collection surface. To reduce or preferably eliminate the entanglement of the thermoset fiber, the present invention passes the fiber through a diffusion chamber or region. As previously discussed, the diffusion chamber dissipates the kinetic energy of the second flowing gas stream. Thus, the process allows the fibers to fall in an unentangled manner onto the laydown surface where they may be collected in a relatively flat two dimensional manner. Preferably, the laydown surface is sufficiently porous to allow for passage of the gas through the fibers.

In an alternative embodiment, the process of the present invention further provides for the use of an exhaust conduit in conjunction with a vacuum pump or blower. According to this embodiment, fibers passing out of the diffusion chamber are collected on a porous laydown surface located within the exhaust conduit. In a preferred embodiment, the laydown surface will be a conveyor belt which transports the fibers out of the exhaust conduit through a rolling seal or vacuum box.

The vacuum pump normally will be connected to the exhaust conduit in a manner to allow for the generation of a vacuum within the exhaust conduit. In this manner, the vacuum pump will pull additional gas down through the fibers as they are collected on the laydown surface. Thus, the vacuum pump enhances the collection of the fibers in a two dimensional format.

Further, the vacuum pump in cooperation with the venturi may preclude the generation of turbulence about the fiber without the need for a second flowing gas stream generated within the venturi. According to this embodiment of the process, the vacuum pump pulls sufficient gas or air through the opening between the spinning head and the venturi to preclude the generation of turbulence about the fiber by using negative pressure, rather than positive pressure to generate the second flowing stream of gas which contacts the fiber. The second flowing stream of gas passes into the venturi along with the fiber and maintains the fiber in relatively straight configuration until the fiber thermosets. Finally, use of the vacuum pump may allow for the recycling of the gas to any part of the system.

Other embodiments of the present invention will be apparent to those skilled in the art from a consideration of this specification or practice of the invention disclosed herein. It is intended that the specification be considered as only exemplary, with the true scope and spirit of the invention being indicated by the following claims.

We claim:

1. A process for preparing relatively straight blow spun fibers comprising:

blow spinning a fiber using at least one flowing stream of gas;

contacting said fiber with at least one additional flowing stream of gas to place said fiber under tension wherein the velocity of said additional flowing stream of gas is greater than the velocity of said fiber; and, thermosetting said fiber while under tension.

2. The process of claim 1, having the additional steps of:

dissipating said at least one additional flowing stream of gas by passing said gas and said fiber into a diffusion chamber;

passing said fiber out of said diffusion chamber; and, collecting said fiber.

3. The process of claim 1, including the step of passing said fiber and said additional flowing stream of gas into a venturi.

4. The process of claim 1, wherein said fiber is spun from a carbonaceous pitch.

5. The process of claim 1, wherein said fiber is spun from a solvated mesophase pitch.

6. A process for preparing relatively straight blow spun fibers comprising heating a spinnable substance to a temperature sufficient to allow said substance to flow followed by forming a fiber by passing said substance into a spinning die and through a capillary located within said die and attenuating said fiber as it exits the capillary by contacting said fiber with at least one stream of gas wherein the improvement comprises:

contacting said fiber with at least one additional flowing stream of gas to place said fiber under tension wherein the velocity of said at least one additional flowing stream of gas is greater than the velocity of said fiber; and, thermosetting said fiber in a relatively straight configuration.

7. The process of claim 6, having the additional steps of:

dissipating said at least one additional flowing stream of gas by passing said gas and said fiber into a diffusion chamber;

passing said fiber out of said diffusion chamber; and, collecting said fiber.

8. The process of claim 7, including the step of passing said fiber and said at least one additional flowing stream of gas into a venturi prior to entering said diffusion chamber.

9. The process of claim 6, wherein said fiber exits said capillary and passes a distance from said die prior to being contacted with said at least one additional flowing stream of gas.

10. An apparatus for blow spinning fibers comprising:

a blow spinning die head containing at least one capillary having a first opening for receiving a spinnable substance and a second opening for passing said substance out of said capillary as a fiber and a means for directing at least one gas stream onto the exiting fiber;

a venturi positioned downstream of said blow spinning die head;

the distance between said venturi and said blow spinning die bead ranging from about 0.25 inches to about 100 inches;

said venturi containing a passage therethrough;

said passage having first and second open ends, said first open end positioned to receive a fiber as it exits said blow spinning die.

11. The apparatus of claim 10, additionally comprising:

a diffusion chamber located downstream of said venturi;

said diffusion chamber having a first open end positioned downstream of said second open end of said passage through said venturi and a second open end to allow said fiber to exit said diffusion chamber.

12. The apparatus of claim 10, additionally comprising means for passing a second gas stream into said first open end of said passage through said venturi.

13. The apparatus of claim 11, wherein said diffusion chamber has an internal diameter which progressively increases from a minimum diameter at the first open end to a maximum diameter at the second open end.

14. The apparatus of claim 11, additionally comprising a laydown surface located beneath said second open end of said diffusion chamber.

15. The apparatus of claim 11, wherein said apparatus is located within a sealed chamber.

16. The apparatus of claim, 15, wherein said sealed chamber contains a non-reactive atmosphere.

17. The apparatus of claim 11, wherein said venturi and said diffusion chamber are a single apparatus.

18. The process of claim 8, wherein said spinnable substance is a solvated mesophase pitch.

19. The process of claim 9, wherein said spinnable substance is a solvated mesophase pitch.

20. The apparatus of claim 10, wherein said distance between said venturi ranges from about 2 to about 12 inches.

21. The apparatus of claim 10, wherein said distance between said venturi ranges from about 2 to about 4 inches.

* * * * *